US008340541B2

(12) United States Patent
Falvo et al.

(10) Patent No.: US 8,340,541 B2
(45) Date of Patent: Dec. 25, 2012

(54) METHOD FOR AUTOMATICALLY CORRECTING TRANSFER PRESSURE NON-UNIFORMITY USING THE CROSS PROCESS UNIFORMITY

(75) Inventors: John R. Falvo, Ontario, NY (US); Eliud Robles-Flores, Webster, NY (US); David B Montfort, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 473 days.

(21) Appl. No.: 12/645,584

(22) Filed: Dec. 23, 2009

(65) Prior Publication Data

US 2011/0150514 A1 Jun. 23, 2011

(51) Int. Cl.
*G03G 15/16* (2006.01)

(52) U.S. Cl. ..... 399/66; 399/316; 399/317

(58) Field of Classification Search ..... 399/66, 399/316, 317
See application file for complete search history.

(56) References Cited

U.S. PATENT DOCUMENTS

| | | | | |
|---|---|---|---|---|
| 5,923,921 | A * | 7/1999 | OuYang et al. | 399/66 |
| 6,330,418 | B1 * | 12/2001 | Ahl et al. | 399/311 |
| 6,760,056 | B2 * | 7/2004 | Klassen et al. | 347/251 |
| 6,766,138 | B2 * | 7/2004 | Obrien et al. | 399/316 |
| 6,845,224 | B1 * | 1/2005 | Gross et al. | 399/316 |
| 7,151,248 | B2 * | 12/2006 | Harush et al. | 250/221 |
| 7,313,343 | B2 * | 12/2007 | Tanaka et al. | 399/101 |
| 2006/0216075 | A1 * | 9/2006 | Sugawara et al. | 399/316 |
| 2007/0196144 | A1 * | 8/2007 | Robles-Flores et al. | 399/316 |
| 2008/0056776 | A1 * | 3/2008 | Gross et al. | 399/296 |
| 2009/0080951 | A1 * | 3/2009 | Montfort et al. | 399/316 |
| 2009/0304424 | A1 * | 12/2009 | Walsh | 399/361 |
| 2010/0135702 | A1 * | 6/2010 | Calamita et al. | 399/301 |

* cited by examiner

*Primary Examiner* — Walter L Lindsay, Jr.
*Assistant Examiner* — David Bolduc
(74) *Attorney, Agent, or Firm* — Ronald E. Prass, Jr.; Prass LLP

(57) ABSTRACT

An electrophotographic marking apparatus and an automatic method for automatically scanning and correcting TAB pressure non-uniformity using a cross-process uniformity controller and a closed loop system. The TAB is contacted with an image on a photoreceptor surface to leave its imprint or footprint on the image, which are analyzed for TAB performance and pressure. This method uses a CPUC full width array in conjunction with a software version for assessing TAB performance. This method continuously monitors the TAB performance during the running of a marking apparatus.

14 Claims, 4 Drawing Sheets

METHOD FOR AUTOMATICALLY CORRECTING TRANSFER PRESSURE NON-UNIFORMITY USING THE CROSS PROCESS UNIFORMITY

This invention relates to electrostatic marking systems and, more specifically, to media transfer stations in such systems.

BACKGROUND

By way of background, in marking systems such as xerography or other electrostatographic processes, a uniform electrostatic charge is placed upon a photoreceptor belt or drum surface. The charged surface is then exposed to a light image of an original to selectively dissipate the charge to form a latent electrostatic image of the original. The latent image is developed by depositing finely divided and charged particles of toner upon the belt or drum photoreceptor surface. The toner may be in dry powder form or suspended in a liquid carrier. The charged toner being electrostatically attached to the latent electrostatic image areas creates a visible replica of the original. The developed image is then usually transferred from the photoreceptor surface to a final support material such as paper and the toner image is fixed thereto to form a permanent record corresponding to the original.

In these electrostatic marking systems, a photoreceptor belt or drum surface is generally arranged to move in an endless path through the various processing stations of the xerographic process sequentially such as a charging station, an exposure station, a development station, a transfer station, a detack station, a fusing station and a cleaning station. Sometimes, as noted, the photoreceptor or photoreceptor surface is in the form of an endless belt and in other systems it is in the form of a drum. In this endless path, several xerographic-related stations are traversed by the photoconductive belt or drum and become worn. Each of these belts is exposed to friction and moved by rollers that provide the belt movement to accomplish the belt purpose. Since the photoreceptor surface is reusable when the toner image is transferred to a final support material such as paper, the surface of the photoreceptor (PR) is constantly abraded and cleaned by a blade and/or brushes and prepared to be used once again in the marking process. The transfer process from the PR to paper uses mechanical devices such as transfer assist blades which can have adverse effects on the final image.

Transfer Assist Blades (TAB's) are devices which apply pressure to the back side of a sheet of media in the transfer zone of a xerographic printing machine. The pressure holds the media against the photoreceptor to improve the transfer of toner to the media. Transfer assist blades are mechanical devices that wear and require replacement. These mechanical devices are moved in and out of a functional position as each sheet of paper enters and exits the transfer zone. If the device is in the functional position between sheets of media, the blade can become contaminated with toner from the inner document patches used for xerographic setups. This contamination can then be transferred to the back side of future media sheets and this is an undesirable condition.

The function of the transfer assist blade is to apply a pressure to the back side of a media forcing it against the imaged photoreceptor. This pressure is applied by pulling the TAB blade petals down against the lifters fingers associated with the separate petals thus forcing of the tips of the transfer assist blade petals against the media. The lifter fingers act as fulcrums as in a see-saw. As the one side of the petal gets pulled down by the TAB extrusion (the part that the petals are mounted onto), the other side rises up against the media. The transfer assist blade is comprised of many independent segments called petals. The lifter fingers are comprised of an outboard solid (non-moving) finger (which is the width of the smallest width sheet the machine will run) and independent fingers that can be raised to act as a fulcrum under the matching petals of the TAB blade when wider media is used. The independent lifter fingers are activated based upon the width of the media currently being printed. If the media is narrower than the full process width, the inboard lifter fingers are not engaged as media enters the transfer zone. If they were activated, the blade petals would contact the photoreceptor not covered by paper or media causing scratches on the photoreceptor surface. These scratches would first cause potential defects in the customer prints once a full width media was being printed again. Secondly, the life of the photoreceptor would be reduced because of these scratches which would drive up printing costs.

TAB Blade petal pressure against the paper can vary for a variety of reasons including the nature of the petals acting at the unmoving and the adjacent moving finger, the distance the petals have to travel "transfer gap", the type of paper media being used, the condition (wear) of the TAB Blade, TAB home position setup and so on. These subtleties of differing pressure against the width of the paper may produce various image artifacts and defects along the width and length of the document.

Currently, the method to assess differing pressure uniformity across the paper width can only be done manually in an open loop mode by trained service personnel. Using trained service personnel involves a financial cost and lost time to the service organization and customer. The current approach is a one time setup. If a problem resurfaces, the lengthy service cycle begins all over again. A problem may not be known until a customer starts a job, or worse, it could occur during a job.

SUMMARY OF THE INVENTION

This invention provides an automatic, hands free and even remote method of assessing and correcting TAB uniformity. This invention uses the Cross Process Uniformity Controller full width array (CPUC) and a closed loop system in conjunction with an "automatic software version of assessing transfer pressure uniformity using the TAB" to constantly monitor and correct or notify personnel regarding TAB pressure performance. TAB blades are defined in U.S. Pat. No. 7,471,922, CPUC sensors are defined in U.S. Pat. No. 6,760,056. Both of these patents are incorporated by reference into the present disclosure.

The present system of capturing a petal pressure profile of the transfer assist blade involves automatically applying powdered toner material onto the TAB Blade petals while the machine is printing and allowing the toner material to be transferred from the TAB Blade petals to the backside of multiple sheets of paper in order to establish a petal profile along the width of the sheets. By analyzing the petal profile, a number of image artifacts can be identified and then actions taken to remedy them.

The method of applying the powdered toner to the TAB petal is done by purposely actuating the TAB Blade petals directly onto a developed solid image on the photoreceptor belt by means of readjusting the TAB touch down timing. The petals will all pick up an even amount of toner and deposit it on the backside of the next sheet that moves through the transfer area.

There are a variety of methods to purposely adjust TAB Blade timing in copiers to cause the copier to pick up toner and deposit it on paper. The prior art methods explained above are of a manual nature. All methods can be automated by the present invention for the added benefits of ease, faster diagnosis, less error and use by non-technical operators for use in their own diagnosis.

With this invention the CPUC scan results from the imprint of the TAB petals on the developed image would be compared to stored files either historic (e.g. run and store diagnostic with every new TAB install) or standardized. The scanned comparison results would be used to determine performance traits such as TAB average density thresholds. Based on the comparison results, the automatic software version of assessing transfer pressure uniformity using the TAB would then be used to initiate control actions such as change TAB steps (to increase/decrease force), re-home, etc.

After automatic adjustments were done, the CPUC would then again scan and analyze to access whether further control or service action would be taken. TAB wear patterns, electrostatic non-uniformity and force uniformity thresholds can all be monitored. This data could be used to initiate service action, e.g. alert user of possible issues and trigger TAB cleaning/replacement.

This invention involves using the results from the CPUC scan analysis to directly modify and correct the TAB Transfer subsystem (SS) parameters and possibly other SS parameters versus the current process of affecting SS defects by changing the exposed image. Note that the current CPUC process does not and cannot account for transfer SS variation; this new suggested CPUC process however leverages on the TAB footprint on an exposed image to change TAB/Transfer subsystem (SS) parameters.

The benefits of this invention are great and many. The current prior art diagnosis of TAB performance can be challenging even to experienced personnel. For service and engineering to be able to remotely monitor CPUC scan analysis results of the TAB subsystem will save much time and cost. For CPUC to be able to modify TAB/Transfer subsystem (SS) parameters would raise the bar for present and future copier machines. All of this automatic TAB adjustment is done without turning the copier or marking machine off or down.

Thus, this invention provides a method or a technique to monitor the state of the transfer assist blade (TAB) device in xerographic printers that use it in electrostatic transfer subsystems. The TAB device is exclusively used in transfer systems that employ corona transfer and provides additional contact to the back of the paper to assure good contact to the image being transferred from the photoreceptor. It is provided that a control image, probably solid area, would be developed. The paper would not be transported and with no toner transferred to paper the TAB device would touch down on, and then off, the developed image on the photoreceptor. As the multiple fingers or petals contact the powder image, they leave a fingerprint image behind. This fingerprint is inspected with a full width array image bar, this fingerprint would be detected (e.g. using CPUC sensor), decoded and used to assess the state of the TAB device. Once detected, the pressure on the fingers could be readjusted for maximum performance. The current method is to apply toner to TAB, contact TAB to back of page leaving a mark, then analyze the mark left on the page manually. The present invention provides the advantage of automation. The residual or "negative" image of the TAB petal marks left in the exposed image on the belt is scanned by the CPUC, automating the process.

DETAILED DISCUSSION OF DRAWINGS AND PREFERRED EMBODIMENTS

Figure 1:
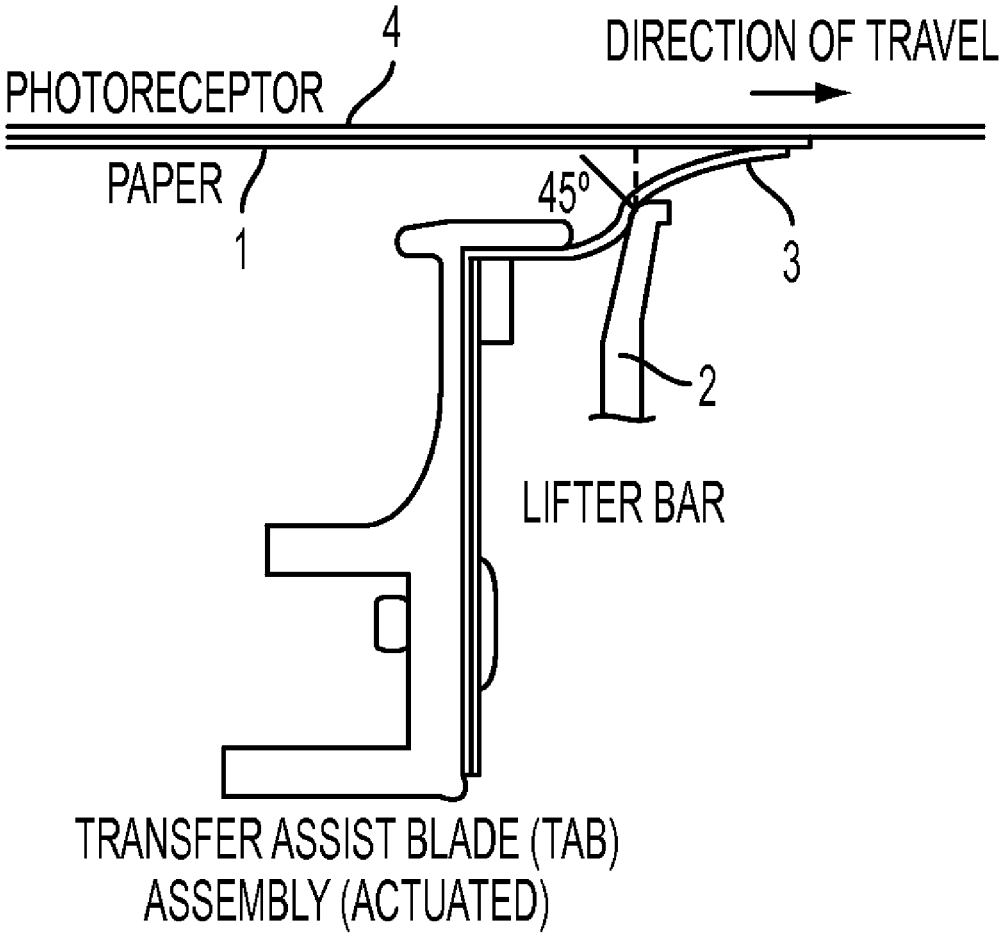
FIG. 1 is a plan side view of a transfer structure using a transfer assist blade (TAB) used in the present invention.

In FIG. 1, a paper sheet 1 is passed from a registration baffle to a transfer station. At the transfer station, the lifter fingers 2 and TAB Blade 3 are shown just prior to contact with the back of the paper 1 and prior to imaged photoreceptor 4 contact with the paper 1. Once the TAB Blade 3 engages against the fingers 2, the TAB petals 5 contact the back of the paper 1 and the imaged toner from the PR 4 is transferred to the paper 1. Once transfer takes place, the TAB Blade is retracted thus moving the Tab petals away from paper, the paper then is transported to the fusing station to form a permanent image on paper 1.

Figure 2:
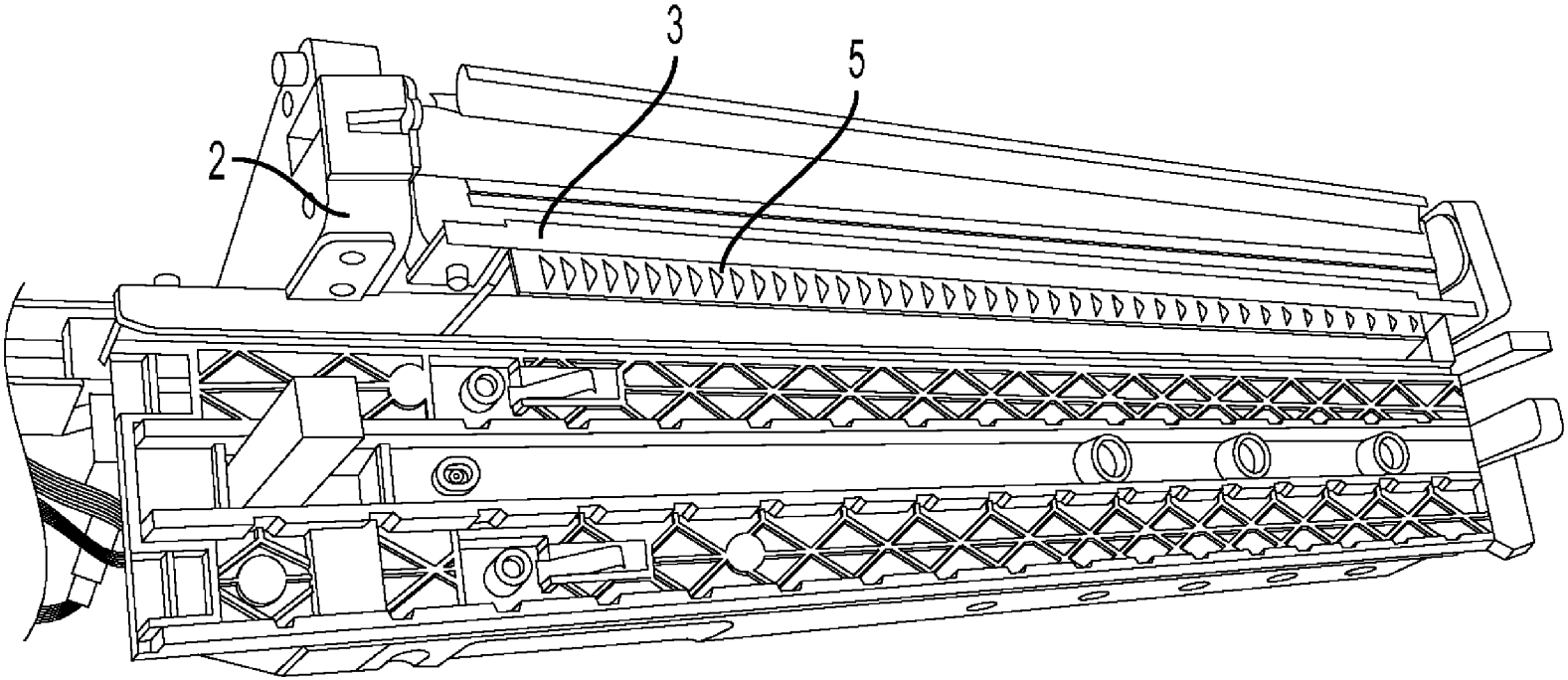
FIG. 2 is a perspective view of a segmented blade lift finger structure used in the present invention.

A segmented TAB Blade 3 with movable lifter fingers 2 is shown in FIG. 2. The function of the TAB blade 3 is to apply pressure to the back of paper 1 forcing it against the PR drum or belt 4. This pressure is applied by pulling the TAB blade petals 5 down against the lifters fingers 2 associated with the separate petals 5 thus forcing of the tips of the transfer assist blade petals 5 against the media. The lifter fingers 2 act as fulcrums as in a see-saw. As the one side of the petal gets pulled down by the TAB extrusion 3 (the part that the petals are mounted onto), the other side raises up against the media. The transfer assist blade 3 is comprised of many independent segments called petals.

Figure 3A:
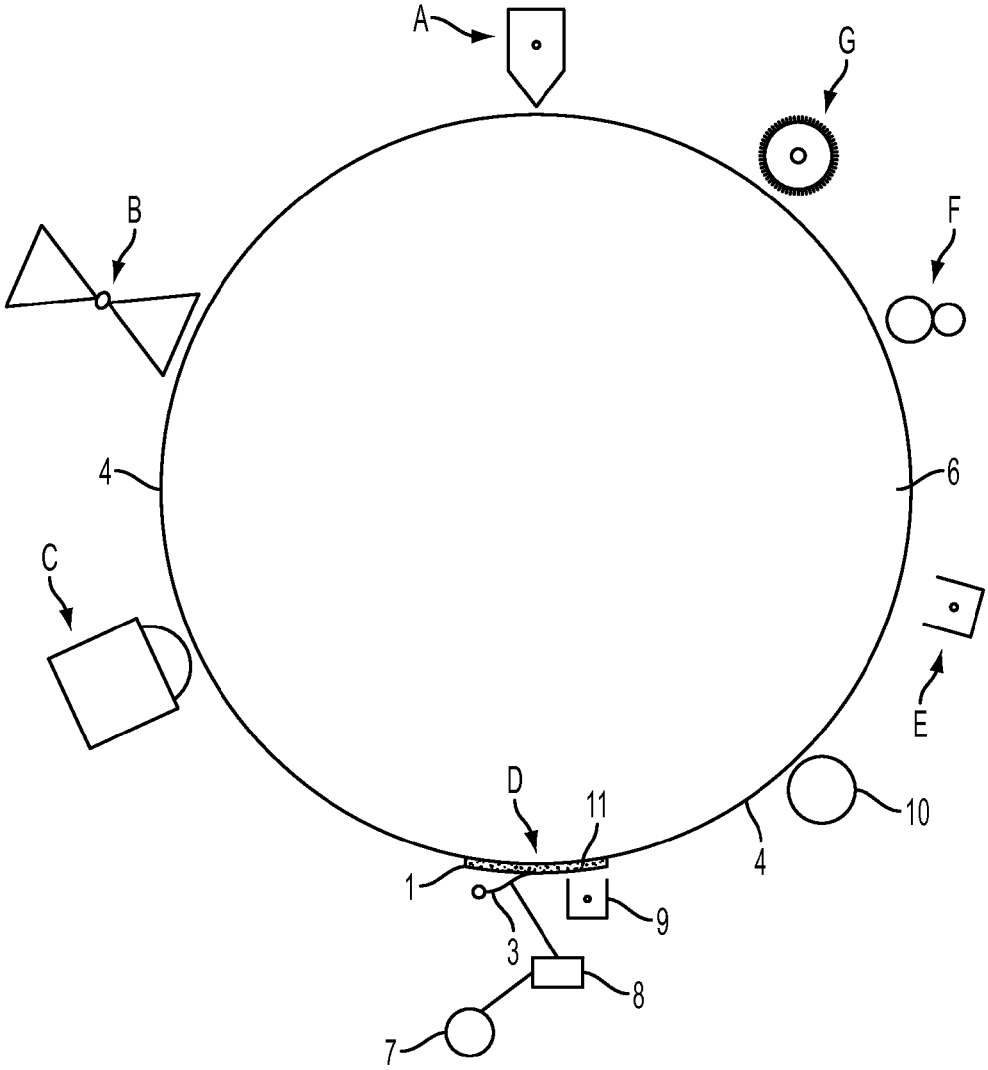
FIG. 3A is a schematic side view of a drum version of an electrostatic marking system useful with the prior step of the automatic method of this invention.

In FIG. 3A a simplified schematic of an electrophotographic marking system is shown using a drum 6 with a photoconductive or photoreceptor surface 4. Station A is the charging station, station B is the exposure station, station C is the developer station, station D is the transfer station, station E is the detack station, Station F is the fusing station, and station G is the cleaning station.

Figure 3B:
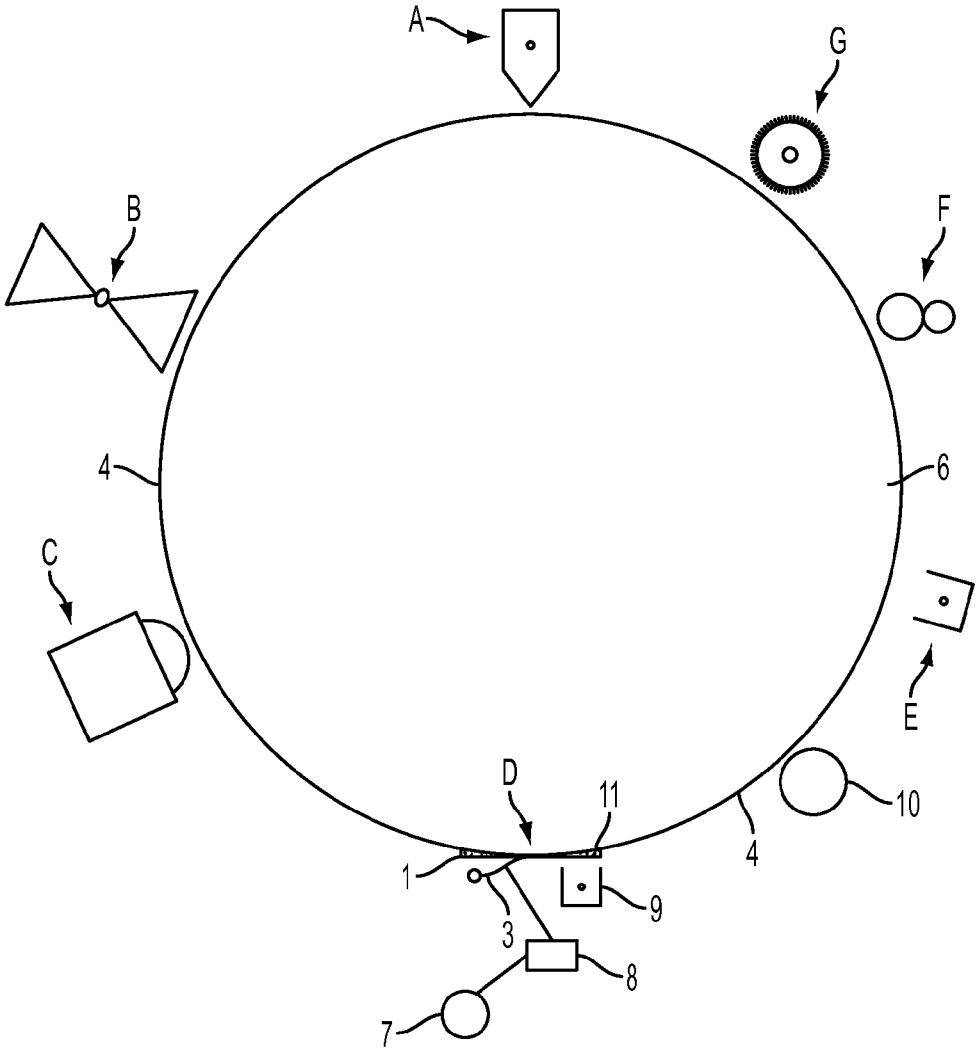
FIG. 3B is a schematic side view of a drum version of an electrostatic marking system useful with the later step of the automatic method of this invention.

In the method for automatically correcting TAB 3 non-uniformity pressure in FIG. 3A, an image 11 (preferably solid area) is first formed on the photoreceptor surface 4 while the dicorotron 9 paper feeder, and stations D, E, are turned off. These stations are turned off in both FIGS. 3A and 3B. The TAB petals 5 are put in contact with this imaged 11 surface 4 to create an imprint of the petals 5 on the image 11 This imprint is then scanned by a CPUC 10 that relays this scanned data to a controller 7 and stepper motor 8. The controller 7 then makes the corrective action on the TAB 3 as indicated by the scanned profile on the image 11 surface.

In summary, this invention provides an automatic system for capturing and correcting pressure of a Transfer Assist Blade (TAB) in an electrophotographic marking apparatus. This system comprises automatically creating an imprint of the TAB petals 5 on the image 11 and scanning the imprinted image 11 with the CPUC and then analyzing the data and taking corrective action.

The system involves scanning the petal footprints with a Cross Process Uniformity Controller (CPUC) sensor to identify TAB petal pressure image conditions. This CPUC is in electrical contact with a system controller. The footprints are then automatically decoded to re-adjust pressure and correct the TAB for maximum performance in the system.

In one embodiment, the TAB is adjusted by a second controller and a stepper motor that receive the profile from the CPUC sensor. The TAB is replaced when the profile analysis indicates replacement of the TAB.

In another embodiment, the controller compares the footprint to a profile of the TAB pressure when the apparatus is new. The controller comprises software containing performance and pressure history of the TAB in the apparatus.

The capturing and correcting of this system is performed automatically and continuously during the apparatus printing cycle. The image on the imaged photoreceptor is preferably a solid area image.

The present invention also comprises a method for automatically correcting TAB pressure in an electrophotographic marking apparatus. This method comprises providing a Cross Process Uniformity Controller in the electrophotographic marking apparatus forming a control developed toner image on the photoreceptor surface of this apparatus and providing that no toner is transferred from the surface to paper at that time. The present invention then contacts the TAB and its petals with the developed image on the surface, leaving an imprint on the image thereby leaving a footprint in the image or profile of the TAB pressure on the paper then inspecting the footprint image on the belt with a full width CPUC and decoding the image using computer to assess the fingerprint of the TAB device on the paper and re-adjusting or replacing the TAB as indicated by the controller after receiving footprint data from the sensor. The above-indicated embodiments are then followed in this method.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An automatic system for capturing and correcting pressure of a Transfer Assist Blade (TAB) in an electrophotographic marking apparatus, the system comprising:

a TAB petal of said TAB, the TAB being configured for being automatically applied to an imaged photoreceptor while the apparatus is printing for forming a petal profile or footprint by allowing said petal to imprint a pattern onto an image on the surface of said imaged photoreceptor, said petal profile extending along a width of said image;

a Cross Process Uniformity Controller (CPUC) sensor for scanning said petal profile or footprint for identifying TAB pressure image conditions, said CPUC sensor being in electrical contact with a system controller for automatically decoding said petal profile or footprint for re-adjusting pressure and correcting said TAB.

2. The system of claim 1 wherein said TAB is adjusted by a second controller and a stepper motor that receive said profile from said CPUC sensor, the system controller being a first controller.

3. The system of claim 1 wherein said TAB is replaced when said profile indicates replacement of said TAB.

4. The system of claim 1 wherein said controller compares said footprint to a profile of said TAB pressure when said apparatus was new.

5. The system of claim 1 wherein said controller comprises software containing performance and pressure history of said TAB in said apparatus.

6. The system of claim 1 wherein said capturing and correcting is performed automatically and continuously during said apparatus printing cycle.

7. The system of claim 1 wherein said image on said imaged photoreceptor is a solid area image.

8. A method for automatically correcting TAB pressure in an electrophotographic marking apparatus using a Cross Process Uniformity Controller (CPUC), the method comprising:

forming a control developed toner image on a photoreceptor surface of said apparatus;

causing a TAB petal of a TAB to contact said developed toner image on said surface whereby a TAB pressure of said contact forms a footprint image or profile in said toner image detecting said footprint image on said toner image with a CPUC sensor, said sensor being connected to a CPUC controller;

decoding said footprint image using said CPUC controller to produce footprint data of said TAB device; and re-adjusting or replacing said TAB after producing said footprint data based on said footprint image detected by said CPUC sensor.

9. The method of claim 8 wherein said TAB is adjusted by a second controller and a stepper motor that receive said profile from said CPUC sensor, the CPUC controller being a first controller.

10. The method of claim 8 wherein said TAB is replaced when said profile indicates replacement of said TAB.

11. The method of claim 8 wherein said controller compares said footprint to a profile of said TAB pressure when said apparatus was new.

12. The method of claim 8 wherein said controller comprises software containing performance and pressure history of said TAB.

13. The method of claim 8 wherein said capturing and correcting is performed automatically and continuously during a printing cycle of said apparatus.

14. The method of claim 8 wherein said image on said imaged photoreceptor is a solid area image.

* * * * *